US005713398A

United States Patent [19]

Josef

[11] Patent Number: 5,713,398

[45] Date of Patent: Feb. 3, 1998

[54] PAPERMAKER'S FABRIC HAVING PAIRED DIFFERENT MACHINE-DIRECTION YARNS WEAVING AS ONE

[75] Inventor: Michael J. Josef, Greenville, S.C.

[73] Assignee: Albany International Corp., Albany, N.Y.

[21] Appl. No.: 759,032

[22] Filed: Dec. 2, 1996

[51] Int. Cl.[6] ..... D03D 13/00; D03D 15/00

[52] U.S. Cl. ..... 139/383 A; 139/425 A; 139/383 AA

[58] Field of Search ..... 139/383 A, 383 AA, 139/425 A

[56] References Cited

U.S. PATENT DOCUMENTS

| | | | |
|---|---|---|---|
| 4,149,571 | 4/1979 | Burroughs | 139/383 A |
| 4,611,639 | 9/1986 | Bugge | 139/383 A |
| 4,636,426 | 1/1987 | Fleischer | 139/425 A |
| 5,089,324 | 2/1992 | Jackson | 139/383 AA |
| 5,458,161 | 10/1995 | Scarfe | 139/383 AA |
| 5,465,764 | 11/1995 | Eschmann et al. | 139/425 A |
| 5,473,981 | 12/1995 | Mazaki | 139/383 A |
| 5,562,968 | 10/1996 | Fry | 139/383 A |
| 5,609,931 | 3/1997 | Delavallade | 139/383 A |

*Primary Examiner*—Andy Falik

*Attorney, Agent, or Firm*—Kane, Dalsimer, Sullivan, Kurucz, Levy, Eisele and Richard, LLP

[57] ABSTRACT

A papermaker's fabric includes a system of machine-direction (MD) yarns interwoven with a system of cross-machine direction (CD) yarns. The MD yarns are pairs of a first MD yarn and a second MD yarn. The first MD yarn and the second MD yarn in each pair are different from one another. The first MD yarn is of a substantially rectangular cross section having a preselected width and thickness. The second MD yarn may be either of a substantially rectangular cross section or of a circular cross section. If of a substantially rectangular cross section, the second MD yarn is narrower than the first MD yarn. The thickness, or diameter, of the second MD yarn is less than that of the first MD yarn. The first and second MD yarns of each pair weave side-by-side as a single yarn with the CD yarns through the fabric.

12 Claims, 3 Drawing Sheets

PAPERMAKER'S FABRIC HAVING PAIRED DIFFERENT MACHINE-DIRECTION YARNS WEAVING AS ONE

BACKGROUND OF THE INVENTION

1. Field of the Invention

The present invention relates to the papermaking arts. More specifically, the present invention is a papermaker's fabric for use on the dryer section of the papermachine, such a fabric being commonly referred to as a dryer fabric.

2. Description of the Prior Art

During the papermaking process, a fibrous web is formed by depositing a fibrous slurry on a forming fabric in the forming section of a papermachine. A large amount of water drains from the slurry through the forming fabric during this process, leaving the fibrous web on the surface of the forming fabric.

The newly formed web proceeds from the forming section to a press section, which includes a series of press nips. The fibrous web passes through the press nips supported between two such press fabrics. In the press nips, the fibrous web is subjected to compressive forces which squeeze water therefrom. This water is accepted by the press fabric or fabrics, and, ideally, does not return to the web.

The web finally proceeds to the dryer section, which includes at least one series of rotatable dryer drums or cylinders, heated from within by steam. The web is directed in a sinuous path sequentially around each in the series of drums by one or more dryer fabrics, which hold the web closely against the surfaces of the drums. The heated drums reduce the water content of the web to a desirable level through evaporation.

The surface characteristics of the fabrics used in the forming and press sections of the papermachine have a direct bearing on the surface properties of the paper being produced. This is also true in the dryer section, where, as stated above, the dryer fabric holds the web closely against the surfaces of the heated dryer cylinders. To promote drying efficiency by increasing the surface area of the dryer fabric directly in contact with the web, and to reduce the marking of the web by the fabric, the dryer fabrics are typically woven to have surfaces which are as smooth as possible. In recent years, one approach that has been taken to provide dryer fabrics with such surfaces has been to include flat monofilament yarns in their woven structures.

As is well-known, sheet disturbance ("flutter") at elevated machine speeds may be reduced by decreasing the permeability of the dryer fabric. Permeability may be decreased by crowding the yarns more closely to one another during the weaving of the fabric, or by including stuffer yarns or other materials in the weave structure to block the flow of air therethrough.

Where flat monofilament yarns are included in a dryer fabric, however, the decrease in permeability achieved by crowding the yarns more closely to one another in the weave structure may be accompanied by an increased susceptibility to wrinkling both during in-house processing and after installation on the dryer section of a papermachine. This is particularly the case where flat monofilament yarns are next, or contiguous, to one another on the surface of the dryer fabric.

The present invention is a dryer fabric which includes flat monofilament yarns, but which is woven in a manner that leaves it less susceptible to the above-noted deficiencies of prior-art fabrics.

SUMMARY OF THE INVENTION

Accordingly, the present invention is a dryer fabric, although it may find application in any of the forming, press and dryer sections of a papermachine.

As such, the present invention is a papermaker's fabric for the forming, press and dryer sections of a papermachine. The fabric includes a system of machine-direction (MD) yarns interwoven with a system of cross-machine direction (CD) yarns.

The MD yarns comprise pairs of a first MD yarn and a second MD yarn. The first and second MD yarns of each pair weave side-by-side one another as a single yarn through the fabric, and are different from one another.

The fabric is preferably of a single-layer weave, such as a plain weave.

The first MD yarns of each pair have a substantially rectangular cross section with a preselected width and thickness. The second MD yarns of each pair may also be of substantially rectangular cross section, in which case they are of a width narrower than that of their respective first MD yarns, and of a thickness either equal to or less than that of their respective first MD yarns.

The second MD yarns of each pair may also be of a circular cross section, in which case they are of a diameter either equal to or less than the thickness of their respective first MD yarns.

The CD yarns may be of a circular cross section.

One of the first and second MD yarns in each pair may form a seaming loop at a widthwise edge of the fabric so that it may be joined into endless form with a pin seam.

Alternatively, one of the first and second MD yarns in each pair may be woven around seaming spirals at the widthwise edges of the fabric to connect the seaming spirals thereto, so that the fabric may be joined into endless form with an in-line spiral seam.

In addition, the first MD yarns may be of one polymeric resin material, and the second MD yarns may be of another different polymeric resin material, so that the MD yarns, that is, the first and second MD yarns taken together, may have the desirable characteristics of both polymeric resin materials.

The present invention will now be described in more complete detail, with frequent reference being made to the drawing figures identified below.

DETAILED DESCRIPTION OF THE PREFERRED EMBODIMENT

Figure 1:
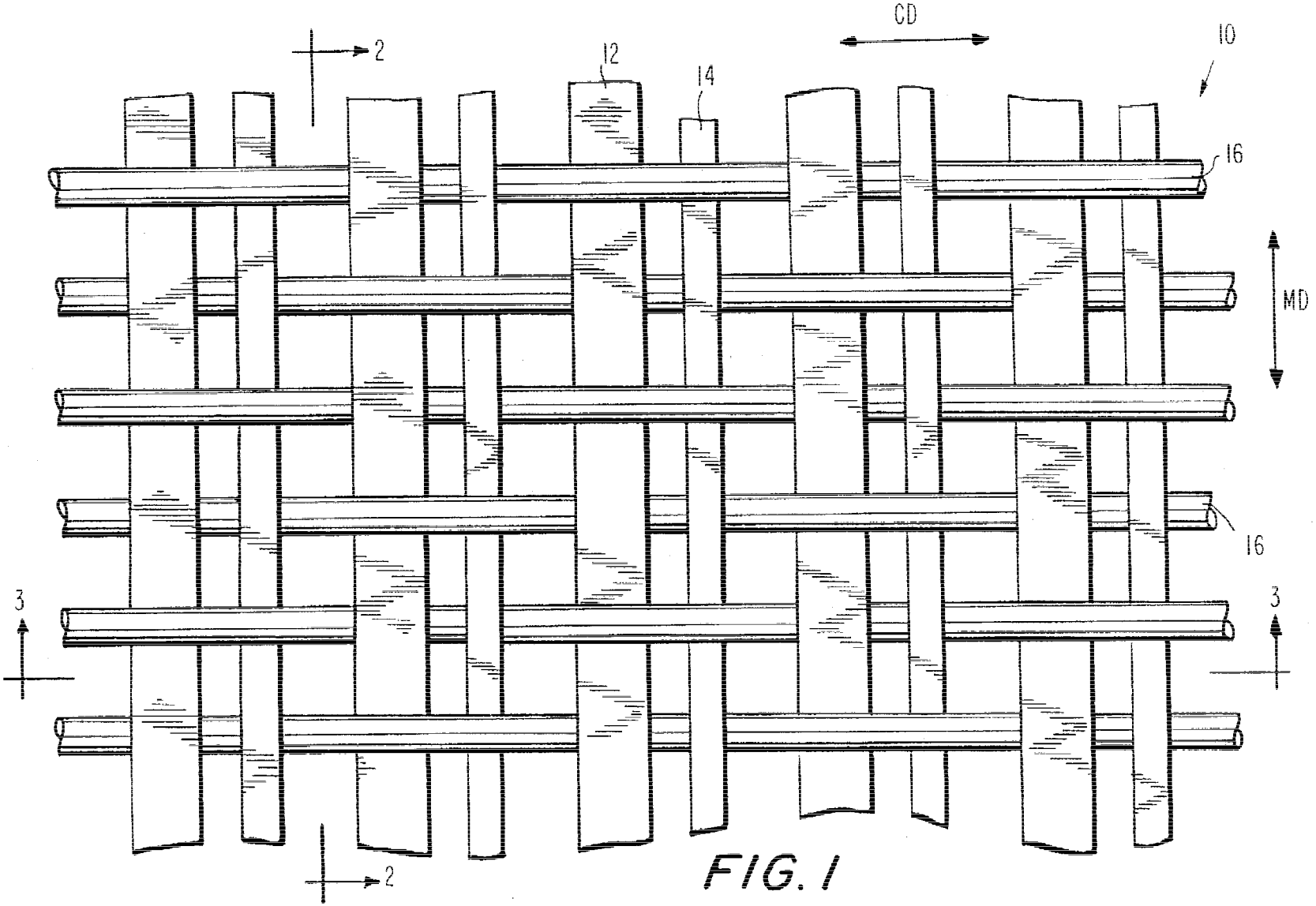
FIG. 1 is a plan view of the upper surface of the papermaker's fabric of the present invention.

With reference now to the figures, FIG. 1 is a plan view of the upper surface of the papermaker's fabric 10 of the present invention. In FIG. 1, the machine direction (MD) and cross-machine direction (CD) are as indicated. While only the upper surface is visible, it will be apparent to the reader from the description to follow that the lower surface has a similar appearance. The spacing between the yarns of the papermaker's fabric 10 in this and other figures is greatly exaggerated for the sake of clarity. In fact, the yarns are woven rather tightly to provide papermaker's fabric 10 with a permeability to air of less than 200 cubic feet per minute per square foot at 0.5 inch $H_2O$-pressure.

Papermaker's fabric 10 is preferably woven in a single-layer weave, and is so represented in the several drawing figures. A plain weave is a preferred single-layer weave, although, depending upon the application, a twill or satin weave may be used.

Papermaker's fabric 10 comprises machine-direction (MD) yarns 12, 14 interwoven with cross-machine direction (CD) yarns 16. MD yarns 12, 14 weave with CD yarns 16 together side-by-side through the fabric 10. That is to say, more particularly, MD yarns 12, 14 weave as one yarn with CD yarns 16.

MD yarns 12, 14 are different from one another in cross-sectional shape, and perhaps also in composition. One of the MD yarns 12, 14 may be used to form seaming loops at the two widthwise edges of the fabric 10 to join it into endless form upon installation on the dryer section of a papermachine with a pin seam. That is, MD yarns 12 or MD yarns 14 may be used to form the seaming loops.

Alternatively, one of the MD yarns 12, 14 may be used to connect seaming spirals to the two widthwise edges of the fabric 10, so that the fabric 10 may be joined into endless form with an in-line spiral seam. That is, MD yarns 12 or MD yarns 14 may be used to connect the seaming spirals.

MD yarns 12, 14, as indicated above, weave side-by-side, as one, for the length of the fabric 10. Although fabric 10 has been depicted exaggeratedly open in FIG. 1, MD yarns 12, 14 in each pair thereof actually abut against one another for the length of the fabric 10. A consequence of this paired, side-by-side relationship between MD yarns 12, 14 is the elimination of one half of the holes through the fabric 10 providing it with a desired reduction in permeability to air.

Figure 2:
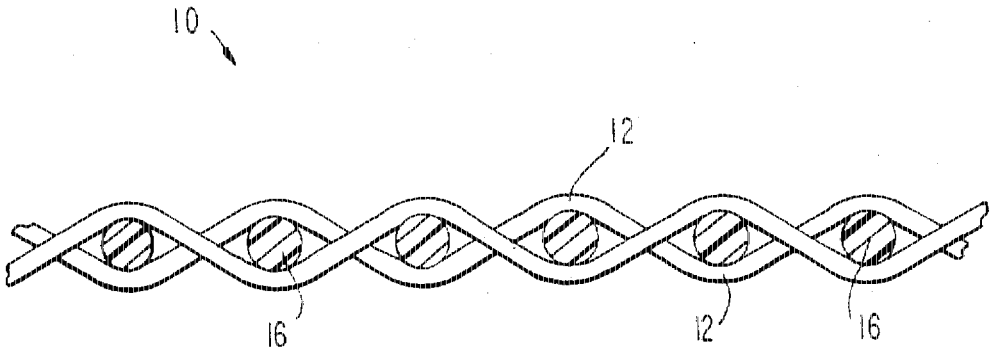
FIG. 2 is a cross-sectional view, taken as indicated by line 2---2 in FIG. 1, of the papermaker's fabric.

FIG. 2 is a cross-sectional view taken as indicated by line 2—2 in FIG. 1. MD yarns 12 are depicted as weaving with CD yarns 16 in a single-layer plain weave. MD yarns 14 are hidden behind the MD yarns 12 with which they are paired in the view given in FIG. 2. CD yarns 16 are of circular cross section.

Figure 3:
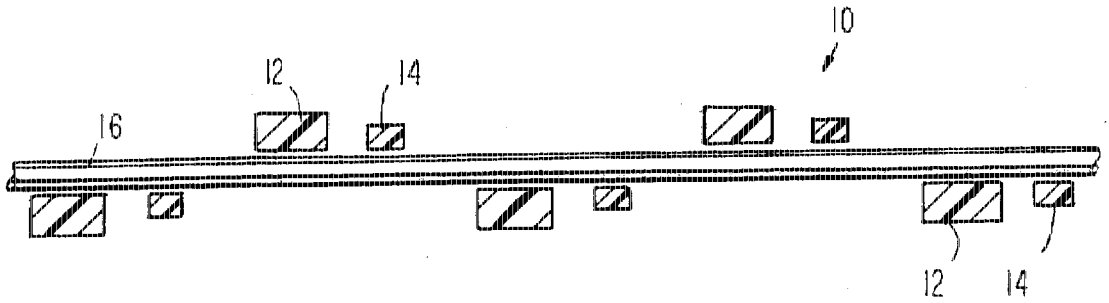
FIG. 3 is a cross-sectional view, taken as indicated by line 3---3 in FIG. 1.

FIG. 3 is a cross-sectional view taken as indicated by line 3—3 in FIG. 1. MD yarns 12, 14 are depicted as having rectangular cross sections. In practice, the cross sections would not have the sharp corners illustrated; in fact, the corners would tend to be slightly rounded, a consequence of the material of MD yarns 12, 14 remaining liquid for a short interval following their extrusion through a die having a rectangular opening.

In the embodiment shown in FIG. 3, MD yarns 12 are thicker and wider than MD yarns 14. When MD yarns 12, 14 so compare, MD yarns 12 contact the paper sheet being dried and stationary, perhaps rotating, elements on the papermachine, thereby sparing MD yarns 14 from such contact. This ensures a longer operating life for the MD yarns 14.

MD yarns 12, 14 and CD yarns 16 may be monofilament yarns of any of the synthetic polymeric resins used in the production of such yarns for papermachine clothing. Polyester and polyamide are but two examples of such materials. Other examples of such materials are yarns of polyphenylene sulfide (PPS), which is commercially available under the name RYTON®, and yarns of a modified heat-, hydrolysis- and contaminant-resistant polyester of the variety disclosed in commonly assigned U.S. Pat. No. 5,169,499, and used in dryer fabrics sold by Albany International Corp. under the trademark THERMONETICS®. U.S. Pat. No. 5,169,499 is incorporated herein by reference.

Two different MD yarns 12, 14 are used because no single yarn can have all of the characteristics required of an MD yarn in a dryer fabric: strength, abrasion resistance, hydrolysis resistance and flex resistance. As such, it may be desirable to provide MD yarns 12 of one polymer and MD yarns 14 of another polymer, so that the two yarns, MD yarns 12, 14, can have all of the desirable properties of both polymers.

Figure 4:
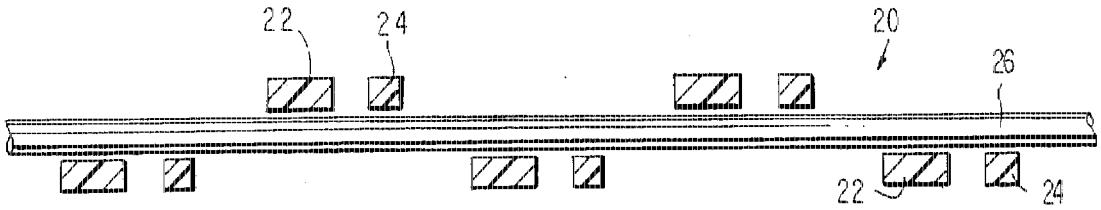
FIG. 4 is a cross-sectional view, analogous to that given in FIG. 3, of a second embodiment of the present invention.

FIG. 4 is a cross-sectional view, analogous to that given in FIG. 3, of a second embodiment of the present invention. Papermaker's fabric 20 comprises MD yarns 22, 24 and CD yarns 26. MD yarns 22, 24, both of rectangular cross section, have the same thickness, but MD yarn 24 is narrower in width than MD yarn 22, and is easier to use in seaming the fabric 20 than the wider MD yarn 22. In all other respects, papermaker's fabric 20 is identical to papermaker's fabric 10.

Figure 5:
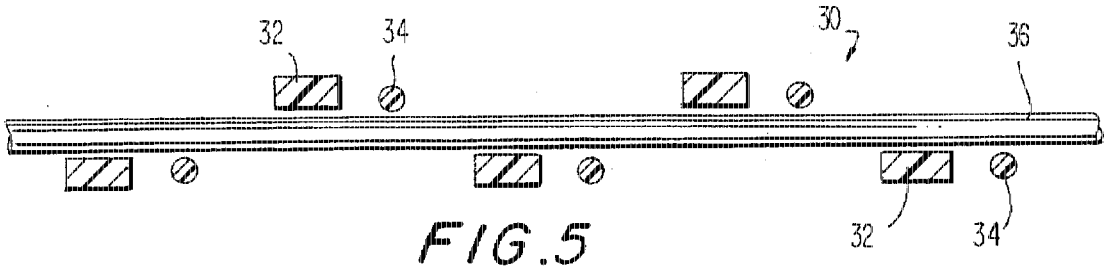
FIG. 5 is a cross-sectional view, also analogous to that given in FIG. 3, of a third embodiment of the present invention.

Similarly, FIG. 5 is a cross-sectional view, also analogous to that given in FIG. 3, of a third embodiment of the present invention. Papermaker's fabric 30 comprises MD yarns 32, 34 and CD yarns 36. MD yarns 32 have a rectangular cross section, while MD yarns 34 have a circular cross section of diameter less than the thickness of MD yarns 32. In this case, MD yarns 32 contact the paper sheet being dried and stationary, perhaps rotating, elements on the papermachine, thereby sparing MD yarns 34 from such contact. In all other respects, papermaker's fabric 30 is identical to papermaker's fabric 10.

Figure 6:
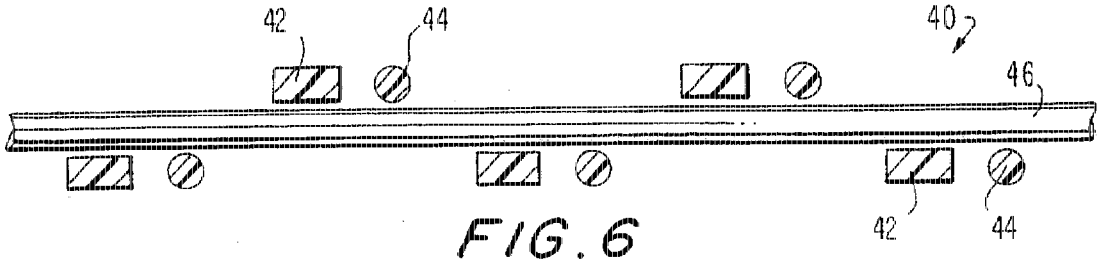
FIG. 6 is a cross-sectional view, also analogous to that given in FIG. 3, of a fourth embodiment of the present invention.

Finally, FIG. 6 is a cross-sectional view, also analogous to that given in FIG. 3, of a fourth embodiment of the present invention. Papermaker's fabric 40 comprises MD yarns 42, 44 and CD yarns 46. MD yarns 42 have a rectangular cross section, while MD yarns 44 have a circular cross section of diameter equal to the thickness of MD yarns 42. In all other respects, papermaker's fabric 40 is identical to papermaker's fabric 10.

As a general example for the embodiments shown in FIGS. 3 and 5, MD yarn 12, or MD yarn 32, could be a yarn of rectangular cross section having a width of 0.88 mm and a thickness of 0.44 mm. Such a yarn would have an aspect ratio (width/thickness) of 2:1. Yarns having aspect ratios of 3:1 or 4:1 could also be used as MD yarn 12, or MD yarn 32.

MD yarn 14 could be a yarn of rectangular cross section having a width of 0.36 mm and a thickness of 0.36 mm. Such a yarn would have an aspect ratio of 1:1 and would have a square cross section. MD yarn 14 could also be a yarn having an aspect ratio of 2:1, so long as its thickness is less than that of MD yarn 12.

As a general example for the embodiments shown in FIGS. 4 and 6, MD yarn 22, or MD yarn 42, could also be a yarn of rectangular cross section having a width of 0.88 mm and a thickness of 0.44 mm. Such a yarn would have an aspect ratio of 2:1. Yarns having aspect ratios of 3:1 or 4:1 could also be used as MD yarn 22, or MD yarn 42.

MD yarn 24 could be a yarn of rectangular cross section having a width of 0.44 mm and a thickness of 0.44 mm. Such a yarn would have an aspect ratio of 1:1 and would have a square cross section. MD yarn 24 could have an aspect ratio other than 1:1, so long as its thickness is the same as that of MD yarn 22, and its width is different from that of MD yarn 22.

Modifications to the above would be obvious to those of ordinary skill in the art, but would not bring the invention so modified beyond the scope of the appended claims.

What is claimed is:

1. A papermaker's fabric for the forming, press and dryer sections of a papermachine comprising:

a system of machine-direction (MD) yarns interwoven with a system of cross-machine direction (CD) yarns, said MD yarns comprising pairs of a first MD yarn and a second MD yarn, said first and second MD yarns of each said pair weaving side-by-side as a single yarn with said CD yarns through said fabric, said first and second MD yarns of each said pair further being different from one another in cross-sectional shape, said first MD yarn in each pair having a substantially rectangular cross section with a preselected first width and first thickness.

2. A papermaker's fabric as claimed in claim 1 wherein said system of MD yarns is interwoven with said system of CD yarns in a single-layer weave.

3. A papermaker's fabric as claimed in claim 2 wherein said single-layer weave is a plain weave.

4. A papermaker's fabric as claimed in claim 1 wherein one of said first and second MD yarns of each pair forms a seaming loop at a widthwise edge of said fabric so that it may be joined into endless form with a pin seam.

5. A papermaker's fabric as claimed in claim 1 wherein one of said first and second MD yarns of each pair connects a seaming spiral at a widthwise edge of said fabric so that it may be joined into endless form with an in-line spiral seam.

6. A papermaker's fabric as claimed in claim 1 wherein said second MD yarn in each pair has a substantially rectangular cross section having a preselected second width and second thickness smaller than said first width and first thickness, respectively, of its respective first MD yarn.

7. A papermaker's fabric as claimed in claim 1 wherein said second MD yarn in each pair has a substantially rectangular cross section having a preselected second width and second thickness, said second width being smaller than said first width of its respective first MD yarn, and said second thickness being equal to said first thickness thereof.

8. A papermaker's fabric as claimed in claim 1 wherein said second MD yarn in each pair has a circular cross section having a preselected diameter smaller than said first thickness of its respective first MD yarn.

9. A papermaker's fabric as claimed in claim 1 wherein said second MD yarn in each pair has a circular cross section having a preselected diameter equal to said first thickness of its respective first MD yarn.

10. A papermaker's fabric as claimed in claim 1 wherein said CD yarns have a circular cross section.

11. A papermaker's fabric as claimed in claim 1 wherein said first MD yarn in each pair is of a first polymeric resin material and said second MD yarn in each pair is of a second polymeric resin material different from said first polymeric resin material.

12. A papermaker's fabric as claimed in claim 1 wherein said first MD yarn in each pair is of a first polymeric resin material and said second MD yarn in each pair is of a second polymeric resin material identical to said first polymeric resin material.

* * * * *